United States Patent [19]

Young

[11] 3,965,337

[45] June 22, 1976

[54] APPARATUS FOR MONITORING DISPENSED FLUID

[75] Inventor: Loring E. Young, Jefferson, Md.

[73] Assignee: Ark, Inc., Rockville, Md.

[22] Filed: Apr. 30, 1975

[21] Appl. No.: 573,585

[52] U.S. Cl. ..... 235/92 FL; 222/26; 235/94 A

[51] Int. Cl.[2] ..... G06M 3/08; B67D 5/22

[58] Field of Search ..... 222/25, 26, 28, 33, 222/37, 70, 76; 235/92 FL, 94

[56] References Cited

UNITED STATES PATENTS

| | | | |
|---|---|---|---|
| 3,195,774 | 7/1965 | Pipersky et al. | 222/26 |
| 3,231,135 | 1/1966 | Starbuck et al. | 222/26 |
| 3,380,629 | 4/1968 | Kontra et al. | 222/26 |

*Primary Examiner*—Allen N. Knowles
*Assistant Examiner*—Hadd Lane
*Attorney, Agent, or Firm*—Shapiro and Shapiro

[57] ABSTRACT

Draft beer monitoring apparatus in which the amount of beer dispensed is indicated in terms of the sales price, the indicator being controlled by a pair of pulsers operating at different rates associated with the dispensing of a glass or a pitcher of beer. The glass-rate pulser is actuated upon the operation of a switch when the dispensing tap is initially opened. If the tap remains open for a period of time greater than that required to fill a glass, a timer automatically actuates the pitcher-rate pulser instead of the glass-rate pulser.

3 Claims, 1 Drawing Figure

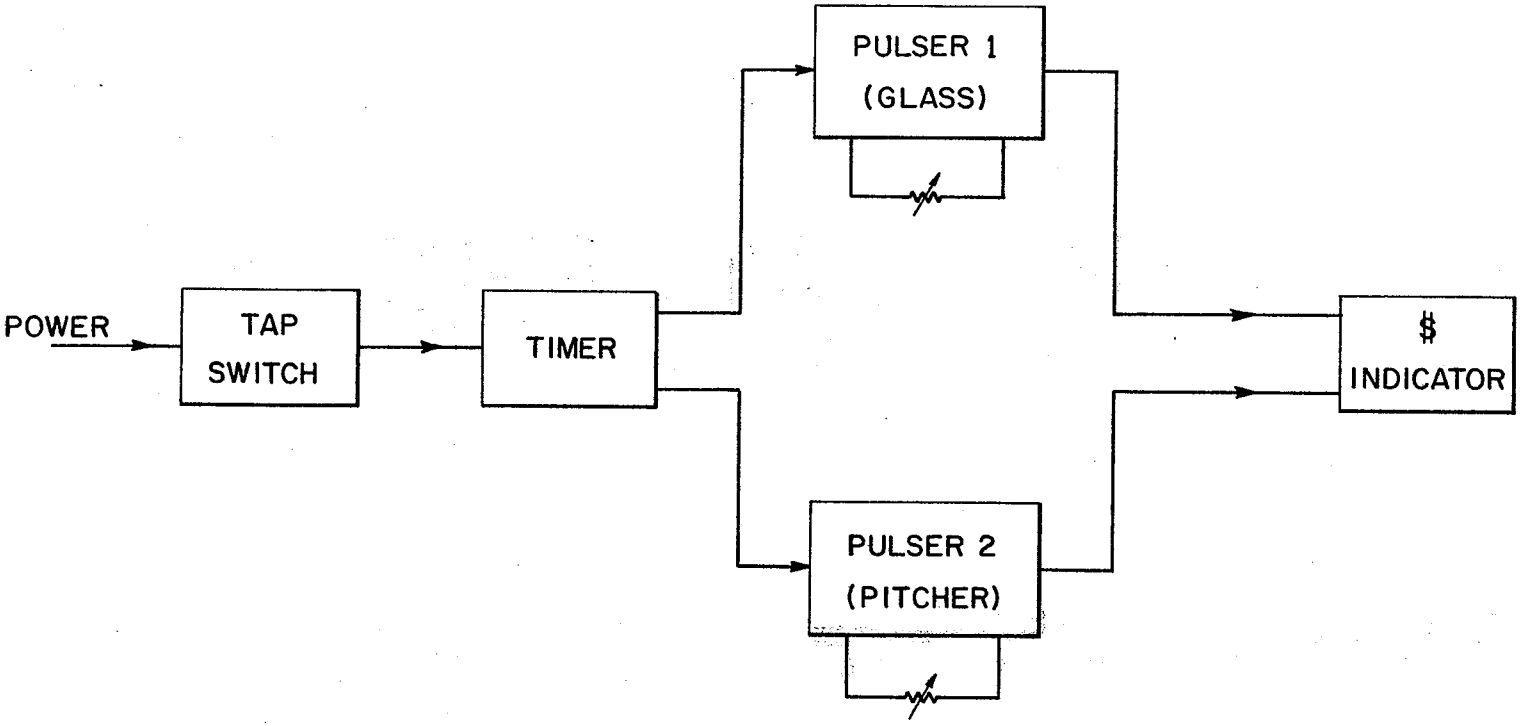
POWER
TAP SWITCH
TIMER
PULSER 1 (GLASS)
PULSER 2 (PITCHER)
$ INDICATOR

APPARATUS FOR MONITORING DISPENSED FLUID

BACKGROUND OF THE INVENTION

This invention is concerned with apparatus for monitoring the dispensing of fluids, particularly the dispensing of draft beer in bars or other establishments.

The problem of maintaining an accurate account of the dispensing of draft beer in bars or saloons has plagued the owners of such establishments for many years. Large economic losses result from the dishonest practices of employees who dispense beer without placing corresponding funds in the till. Since the beer is commonly sold at different prices depending upon whether a glass or a larger container such as a pitcher is filled, it is impossible for the owner of the establishment to ascertain the correct amount of money that should have been received for each keg of beer.

All sorts of schemes have been proposed to monitor the dispensing of beverages, such as beer. The failure of such schemes to come into widespread practice is due primarily to the complexity, expense, and/or unreliability of the monitoring apparatus previously proposed.

BRIEF DESCRIPTION OF THE INVENTION

It is accordingly a principal object of the present invention to provide improved apparatus for monitoring dispensed fluids, such as draft beer, and to avoid or overcome the disadvantages of prior such apparatus.

Briefly stated, in accordance with the preferred form of the invention, an indicator caibrated in monetary terms is controlled alternately by a pair of pulsers, one of which drives the indicator at a rate associated with the dispensing of a glass of beer, for example, and the other of which drives the indicator at a slower rate associated with the dispensing of a larger unit quantity, such as a pitcher. Operation of a tap switch concurrently with the opening of a valve or tap for dispensing the fluid actuates the first pulser. If the tap switch remains operated beyond a predetermined interval of time, a timer actuates the second pulser instead of the first. The indicator thus displays the correct total value of the dispensed fluid, irrespective of the unit quantities in which the fluid is dispensed.

BRIEF DESCRIPTION OF THE DRAWING

The sole FIGURE of the drawing is a block diagram illustrating a preferred form of the invention.

DETAILED DESCRIPTION OF THE INVENTION

Referring to the drawing, wherein reference will be made to the blocks by the labels applied thereto, power is supplied to a TIMER via a TAP SWITCH when the TAP SWITCH is closed concurrently with the opening of a tap for dispensing draft beer, for example. Initially, when the timer commences to operate, power is applied to PULSER 1, which drives an INDICATOR at a rate dependent upon the pulse repetition rate of the PULSER. If the TAP SWITCH remains closed for a predetermined interval of time, and hence the TIMER continues to operate for that period, the TIMER will thereafter actuate PULSER 2 instead of PULSER 2, and PULSER 2 will then drive the INDICATOR at a rate dependent upon the pulse repetition rate of PULSER 2. The TIMER may be a conventional duration timer, such as the type manufactured by Omnetics or Syracuse, which applies an output voltage to one terminal when the TIMER commences operation, for a selected predetermined time thereafter, which instead applies an output voltage to a second terminal when the TIMER continues to operate beyond that predetermined interval, and which resets automatically when power to the TIMER is removed. The pulsers may be conventional adjustable impulse "timers" or pulse generators with fixed pulse-on time and adjustable pulse-off time, for example, such as the type manufactured by Omnetics or Syracuse. The off time and hence the pulse repetition rate may be adjusted by means of the potentiometers illustrated depending upon the desired flow rate and corresponding price. The INDICATOR may be a conventional impulse counter such as the electromagnetic type manufactured by Kessler-Ellis. As shown, a single totalizer calibrated in terms of dollars and cents is used, but if desired separate indicators could be used to totalize the monetary value of the glasses dispensed or the pitchers dispensed, separately. Power to the monitoring apparatus is supplied via a step-down transformer from the ordinary AC lines. An elapsed time meter may also be driven by the TIMER to indicate the total time that the tap has been open.

By virtue of the invention, the dispensing of a fluid such as beer is accurately monitored. The rate of beer flow may be electrically counted in dollars and cents without disturbing the flow path of the beer. The dollar count rate may be adjusted at will, up to 50 cents per second, for example, so that price changes are readily accommodated. The apparatus automatically changes the count rate when the time to fill a glass has been surpassed, automatically accounting for the fact that the flow rate in dollars is more for a glass of beer than for a pitcher of beer, for example.

The apparatus is preferably equipped with conventional tamper switches and warning lights to indicate tampering, such as an attempt to remove the TAP SWITCH from the tap or an attempt to open the houisng in which all of the apparatus except the TAP SWITCH is normally contained. The TAP SWITCH will normally be mounted directly upon the tap, in a manner well known in the art, so that the TAP SWITCH is closed automatically when the tap lever is moved to an open position. If desired, sufficient free play may be provided to permit small flows for topping off a glass of beer without closing the TAP SWITCH.

While a preferred embodiment of the invention has been shown and described, it will be apparent to those skilled in the art that changes can be made in this embodiment without departing from the principles and spirit of the invention, the scope of which is defined in the appended claims.

The invention claimed is:

1. Apparatus for monitoring fluid dispensed in at least two different unit quantities at corresponding monetary rates, comprising indicator means for registering monetary information representative of the amount of said fluid dispensed at said monetary rates, first and second control means for driving said indicator means substantially continuously, when actuated, to cause said indicator means to register said monetary information substantially continuously at a monetary rate dependent upon which of said control means is actuated, switch means operated concurrently with the dispensing of fluid, and means for causing said first control means to be actuated in response to initial operation of said switch means, so that said monetary information is registered at a monetary rate associated with said first control means, and, after a predetermined amount of switch operation time has elapsed, for causing said second control means to be actuated instead of said first control means, so that said information is then registered at a monetary rate associated with said second control means.

2. Apparatus in accordance with claim 1, wherein said indicator means is a pulse-driven totalizer and said control means comprises pulsers which drive said totalizer at different pulse repetition rates.

3. Apparatus in accordance with claim 2, wherein said fluid is a beverage, said one pulser operates at a glass rate, and said other pulser operates at a pitcher rate.

* * * * *